US006963647B1

(12) United States Patent
Krueger et al.

(10) Patent No.: US 6,963,647 B1
(45) Date of Patent: Nov. 8, 2005

(54) CONTROLLED ACOUSTIC WAVEGUIDE FOR SOUNDPROOFING

(75) Inventors: Jan Krueger, Stuttgart (DE); Philip Leistner, Stuttgart (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 09/868,251

(22) PCT Filed: Dec. 15, 1999

(86) PCT No.: PCT/EP99/09966

§ 371 (c)(1),
(2), (4) Date: Sep. 20, 2001

(87) PCT Pub. No.: WO00/36589

PCT Pub. Date: Jun. 22, 2000

(30) Foreign Application Priority Data

Dec. 15, 1998 (DE) ..... 198 61 018

(51) Int. Cl.[7] ..... G10K 11/16
(52) U.S. Cl. ..... 381/71.5; 381/71.9
(58) Field of Search ..... 381/71.5, 71.1, 381/71.3, 71.4, 71.7, 71.8, 71.9, 73.1, 94.1, 381/94.7

(56) References Cited

U.S. PATENT DOCUMENTS

| | | | | |
|---|---|---|---|---|
| 4,527,282 A | | 7/1985 | Chaplin et al. | 381/71 |
| 5,233,137 A | | 8/1993 | Geddes | 181/206 |
| 5,457,749 A | * | 10/1995 | Cain et al. | 381/71.5 |
| 5,550,334 A | * | 8/1996 | Langley | 381/71.5 |
| 5,574,264 A | * | 11/1996 | Takemori et al. | 381/71.5 |
| 5,619,020 A | * | 4/1997 | Jones et al. | 381/71.5 |
| 6,418,227 B1 | * | 7/2002 | Kuo | 381/71.5 |
| 2003/0053635 A1 | * | 3/2003 | Carme et al. | 381/71.5 |

FOREIGN PATENT DOCUMENTS

| | | |
|---|---|---|
| DE | 40 27 511 C1 | 10/1991 |
| DE | 42 26 885 A1 | 2/1994 |
| DE | 44 46 080 A1 | 6/1996 |
| DE | 196 12 572 A1 | 10/1997 |
| EP | 0 481 450 A1 | 4/1992 |
| WO | WO 97/43754 | 11/1997 |

OTHER PUBLICATIONS

International Search Report for PCT/EP 99/09966 (dated Apr. 20, 2000).

* cited by examiner

*Primary Examiner*—Stella Woo
(74) *Attorney, Agent, or Firm*—Crowell & Moring LLP

(57) ABSTRACT

The invention relates to a controlled acoustic wave guide configured as an elongated hollow chamber (1) which via an opening (2) in its first face end (3) is connected to a sound-conducting channel (4). The longitudinal resonances of the hollow chamber (1) can be adjusted to a sound spectrum to be dampened. To this end diaphragm vibrations are detected by means of a microphone (10) which is positioned directly in front of the diaphragm (8) of at least one loud-speaker (9) at the second face-end (6) of the hollow chamber (1). The microphone signal is then inverted using an amplifier (11) and fed back to the loud-speaker (9) after amplification in accordance with a sensor (12) signal characterizing the sound spectrum in the channel (4).

14 Claims, 10 Drawing Sheets

—— CONTROLLED WAVEGUIDE ACCORDING TO FIG.4 WITH AMPLIFIER (11) TURNED ON AT 20°C IN THE DUCT (4)

—— CONTROLLED WAVEGUIDE ACCORDING TO FIG.4 WITH AMPLIFIER (11) TURNED ON AT 150°C IN THE DUCT (4)

—— CONTROLLED WAVEGUIDE ACCORDING TO FIG.4 WITH AMPLIFIER (11) TURNED ON

—— CONTROLLED WAVEGUIDE ACCORDING TO FIG.4 WITH AMPLIFIER (11) TURNED OFF

CONTROLLED ACOUSTIC WAVEGUIDE FOR SOUNDPROOFING

This application claims the priority of PCT International No. PCT/EP99/09966 filed Dec. 15, 1999 and German Priority Document 198 61 018.1 filed Dec. 15, 1998, the disclosures of which are expressly incorporated by reference herein.

BACKGROUND OF THE INVENTION

The present invention relates to a controlled acoustic waveguide for sound absorption in the manner of an elongate hollow chamber which communicates with a sound—transmitting duct via an opening on its first end surface. The longitudinal resonances may be tuned to a sound spectrum to be attenuated, by detecting the membrane vibrations with a microphone located directly in front of the membrane of at least one loudspeaker on the second end surface of the hollow chamber and by inverting the microphone signal with an amplifier and by feedback of the inverted microphone signal to the loudspeaker in an amplified form in dependence on a signal from a sensor, which is characteristic of the sound in the duct.

Sound absorbers are known for attenuating low-frequency noise in ducts, wherein the longitudinal resonances of elongate hollow chambers, so-called acoustic waveguides, are utilized, e.g. in accordance with the DE 19612572 or Lamancusa, J. S.: "An actively tuned passive muffler system for engine silencing". Proceedings Noise-Con 87, 1987, pp. 313–318. These waveguides are coupled to the sound-transmitting duct via an opening in the end surface thereof and either project orthogonally from the duct or conform thereto while extending in parallel therewith. For the first longitudinal resonance in particular, at which the length of the chamber corresponds to one quarter of the wavelength of the first resonance frequency, high attenuation levels are achieved over a narrow band. This limitation of the frequency range is, however, problematic when either a wide-band absorption is required or when the noise spectrum changes which was taken as a basis when the waveguide was dimensioned, The necessary adaptation of the chamber length is implemented, at least in stages, according to Lamancusa, by the provision of very long chambers with compartments from the very beginning, which may provision of very long chambers with compartments from the very beginning that be opened or closed whenever this is necessary. Another possibility of avoiding the inexpedient narrow-band restriction consists in the simultaneous application of different chamber lengths according to the German Document 196 12 572.

Another group of sound attenuators or absorbers for low frequencies comprises resonant cavities, i.e. both acoustic waveguides according to Okamoto, Y.; Boden, H.; Abom, M.: "Active noise control in ducts via side-branch resonators" in: Journ. of the Acoust. Soc. of America 96 (1994), No. 9, pp. 1533–1538, and equally Helmholtz resonators according to DE 4226885 or the U.S. Pat. No. 5,233,137, which are connected to a sound-transmitting duct or space via an opening and which have properties suitable for variation by electro-acoustical or active components, respectively. These systems share the joint approach that at least one microphone is present in the duct or space. The sound pressure signal so detected is initially filtered, amplified and subjected to further analysis steps and then serves as control variable for at least one loudspeaker in the waveguide or cavity. As a result, the loudspeaker emits a signal which, again upon modification by the resonator, is superimposed with opposite phase onto the sound at the site of the microphone in the duct or cavity, so effecting attenuation of the sound. With these actively influenced resonators, it is possible, on the one hand, to generate and hence also attenuate high sound pressures at low frequencies while, on the other hand, at least the loudspeaker is protected from potential, e.g. thermal, loads in the duct. The disadvantages of these methods include the fixed dimensioning of the resonators independently of possible variations of the sound spectrum in the duct, which is initially taken as a basis, and the lack of protection of the microphone.

According to DE 4027511, a passive sub-system is used instead of the resonant cavities so far mentioned, which consists preferably of passive absorber layers and protecting cover layers. In this case, too, the function of the electro-acoustical components mounted on the rear side relates to the modification of the passive absorber, aiming at the generation of a theoretically optimum acoustic impedance on the front side of the absorber, which impedance promise the highest propagation attenuation possible in the connected sound-transmitting duct. This method requires that a signal-shaping circuit proposed in DE 4027511 firstly compensates the intrinsic characteristics of all the electro-acoustic components (microphone, loudspeaker, box, etc.) and secondly imprints on the system the desired terminating impedance. The characteristics of the components have been thoroughly studied and described. In accordance with the results the conversion of this method into practice inevitably requires the implementation of complex transmission functions of the signal-shaping circuit, which cannot be realised in practical application except in approximation.

Reactive sound absorbers are operative without any additional passive layers or resonance systems according to WO 97/43754, wherein the membrane of a loudspeaker is a direct component of the wall in a sound-transmitting duct and wherein the membrane vibrations controlled or amplified with a feed-back circuit take a direct influence on the sound field in the duct. The adaptation to a sound spectrum to be attenuated, which is also necessary in this case, is based on the dimensioning of the resonance system consisting of the membrane mass and the pneumatic cushion in the form of the rear volume, which exists there-behind.

SUMMARY OF THE INVENTION

It is an object of the present invention to improve the efficiency of sound attenuation in ducts or the like and to reduce the manufacturing costs of the inventive device.

This problem has been solved by the device of the present invention in which the longitudinal resonances of said hollow chamber are tunable to a sound spectrum to be attenuated, by detecting the membrane vibrations by a microphone located directly in front of the membrane of at least one loudspeaker on the second end surface of said hollow chamber, and by inverting the microphone signal by an amplifier and by feedback of the inverted microphone signal to said loudspeaker in an amplified form in dependence on a signal from a sensor, which is characteristic of the sound in the duct.

The advantages of the present invention over existing sound absorber includes the following features:

In distinction from known acoustic waveguides, the controlled waveguide of the present invention achieves a high sound attenuation at low frequencies at a reduced structural volume (with the length of the hollow chambers reduced by up to roughly four times).

The frequency range with a high sound absorption of the inventive controlled waveguide is extended to roughly two octaves due to the adaptivity to variable acoustic spectrums.

The controlled waveguide of the present invention is characterized by a simple structure and particularly by a low-price analog amplification and control without expensive electronic filters or digital signal analysis.

Furthermore, all the electro-acoustic components in the hollow chamber of the controlled waveguide of the present invention are protected from influences produced by flow, dust and aggressive media in the duct over rather long periods.

This protection is also extended to high temperature, e.g. in exhaust gas systems, because the inventive controlled waveguide offers various possibilities of an efficient thermal decoupling from the duct.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWINGS

Figure 1:
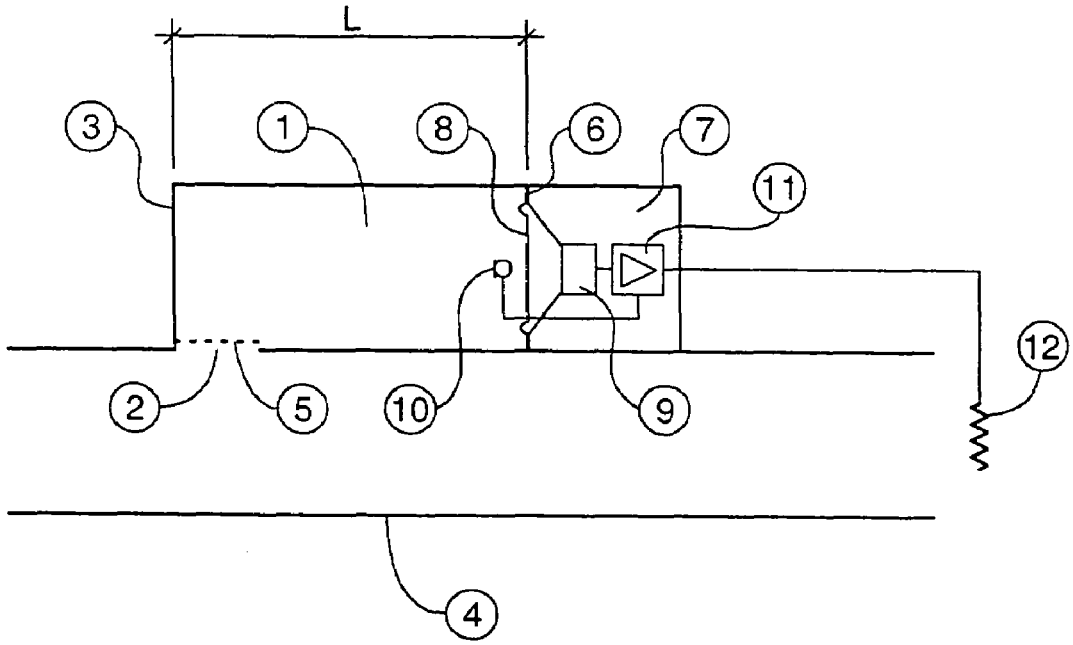
FIG. 1 is a schematic view of the controlled waveguide in accordance with the present invention.

The starting point of the controlled waveguide according to FIG. 1 consists in an elongate hollow chamber (1) presenting distinct longitudinal resonances. The chamber (1) is acoustically connected via an opening (2) on the first end surface (3) to a sound-transmitting duct (4) or space. The length L of the hollow chamber (1) is dependent on the sound spectrum occurring in the duct (4), wherein the frequencies with the greatest sound amplitude vary within a defined range, e.g. as a consequence of a varying gas temperature in the duct (4), as a function of the operation. In this case the length L corresponds to roughly one quarter of the wavelength of the upper limit frequency of this range.

The membrane (8) of at least one loudspeaker (9) is provided on the second end surface (6) of the hollow chamber (1), in front of another cavity (7), with the cavity (7) acting as air cushion and the membrane (8) as planar mass forming a resonance system. A microphone (10) is positioned directly in front of the membrane for detecting the membrane vibrations. The microphone signal is applied on the input of an inverting amplifier (11) with an adjustable gain, which produces an output signal, which serves to control the loudspeaker (9).

As a function of the level of amplification the membrane vibrations hence the acoustically effective length of the hollow chamber (1) undergo a variation, with the acoustic length being definitely (roughly four times) greater than the actual length L. The acoustically effective prolongation of the hollow chamber (1), which is achieved on account of the increased amplification, means a shift of its first longitudinal resonance towards lower frequencies, expediently up to the lower limit of the frequency range of the sound spectrum occurring in the duct (4). The setting of the gain is based on the control signal of at least one additional sensor (12) which supplies a parameter to the amplifier (11) that is characteristic of the frequencies having the highest sound amplitude in the duct.

Temperature sensors in the duct (4), rotational speed detectors on ventilators, generators or motors or engines, as well as elements measuring the gas flow of burners and exhaust systems may be enumerated as examples of a sensor (12). The sensor (12) is expediently operative without particular protective measures such as those required, for instance, in microphones in an exhaust system. An exemplary and particularly simple configuration of the sensor (12) is a temperature-dependent resistor which detects the temperature in the duct (4) and constitutes, at the same time, an element of the feedback branch of an inverting amplifier (11) known per se and hence controls the overall gain achieved by this amplifier. Further expedient embodiments include the application of voltage- and current-controlled amplifiers (11) which broaden the range of contemplated sensors (12) available for selection.

Figure 2:
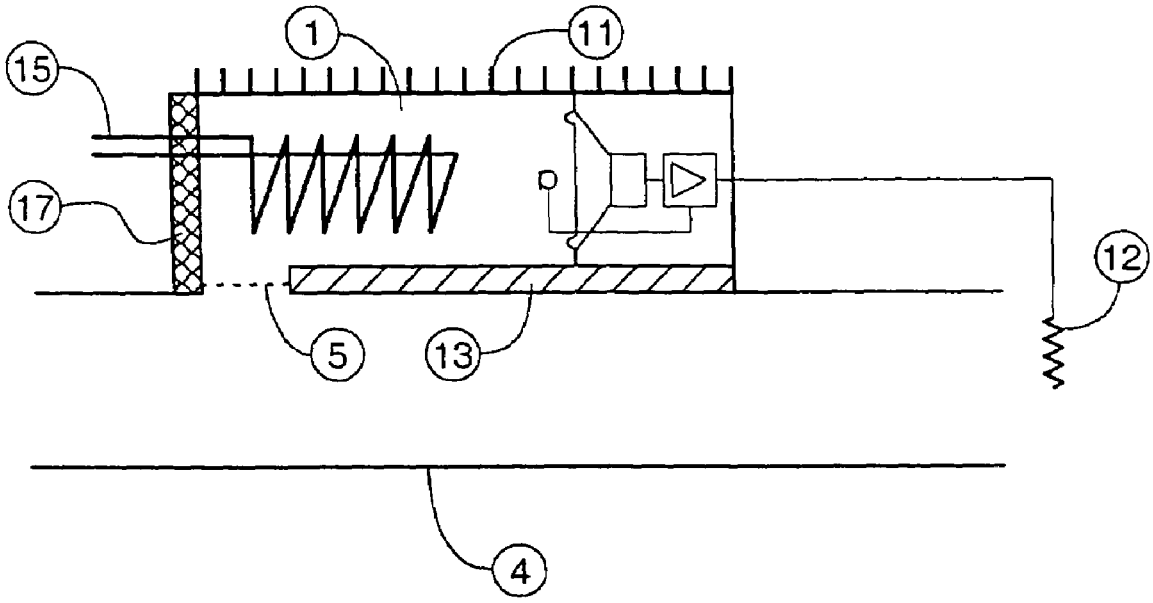
FIG. 2 is a schematic view of an embodiment of the controlled waveguide with a thermal insulating layer between the hollow chamber and the duct, with cooling elements as part of the wall of the hollow chamber, with a forced cooling thermal exchanger, as well as with an absorbing inner wall cladding.
Figure 3:
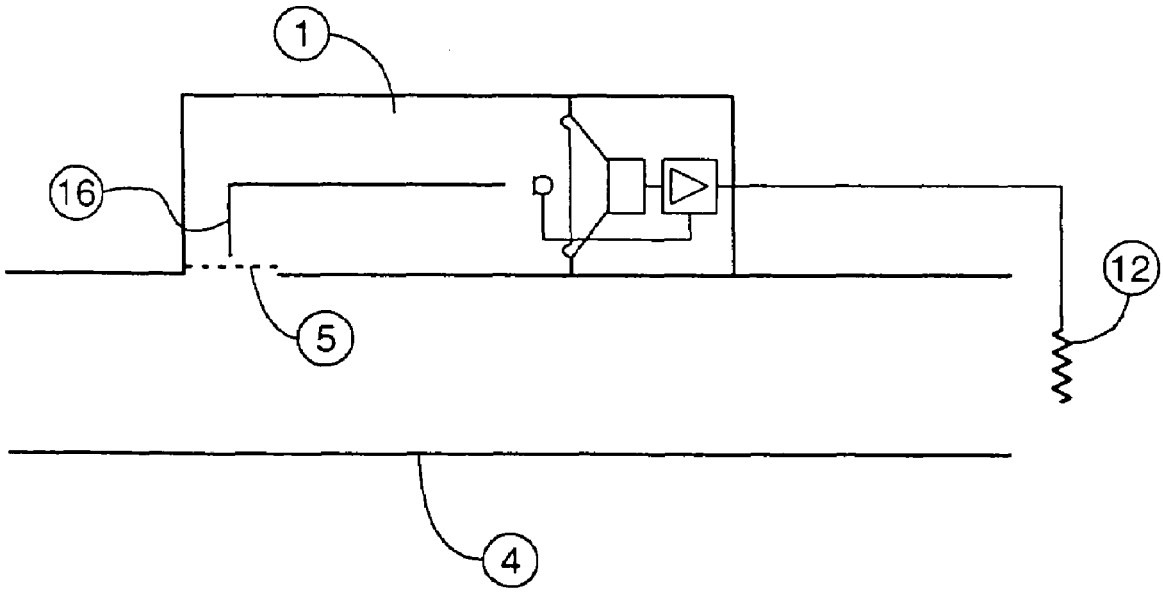
FIG. 3 is a schematic view of another embodiment of the controlled waveguide of the present invention with a subdivision of the hollow chamber into several tubes of different lengths.

A sound-transmitting cover (5) consisting of perforated sheet, non-woven material, sheet material or the like is provided in front of or behind the opening (2) leading to the duct (4) for protection from a possible soiling of the hollow chamber (1) and from entering hot exhaust gas from the duct (4). As a function of structural conditions in the environment of the duct (4), the hollow chamber (1) may be configured in a straight or curved shape, project obliquely or orthogonally from the duct, or conform against the duct (4) in the longitudinal direction. In this case, a thermal insulating layer (13) is disposed between the hollow chamber (1) and the duct (4), as may be seen in FIG. 2. Whenever the hollow chamber (1) must be expected to be heated, the cooling elements (11) illustrated in FIG. 2 as part of the wall of the hollow chamber improve the dissipation of heat in the same manner as a forced cooling of the kind of a thermal exchanger (15) or with so-called Peltier elements in the hollow chamber. A transverse subdivision (16) of the hollow chamber (1) into several tubes of different lengths as well as an absorbing inner wall cladding (17) constitute another advantageous embodiment of the inventive controlled waveguide (FIG. 3) so as to achieve a broader-band attenuation.

Figure 4:
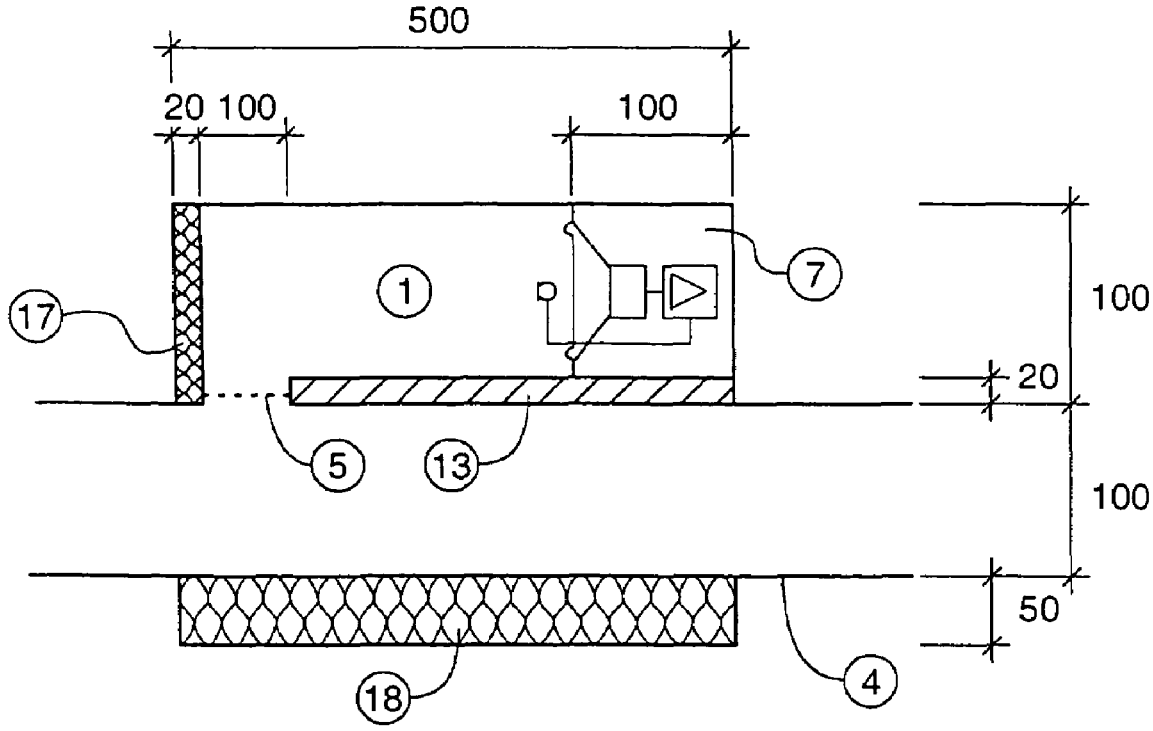
FIG. 4 is a schematic view of still another embodiment of the controlled waveguide with a conventional passive attenuator on the opposite duct wall (with dimensions indicated in mm)
Figure 5:
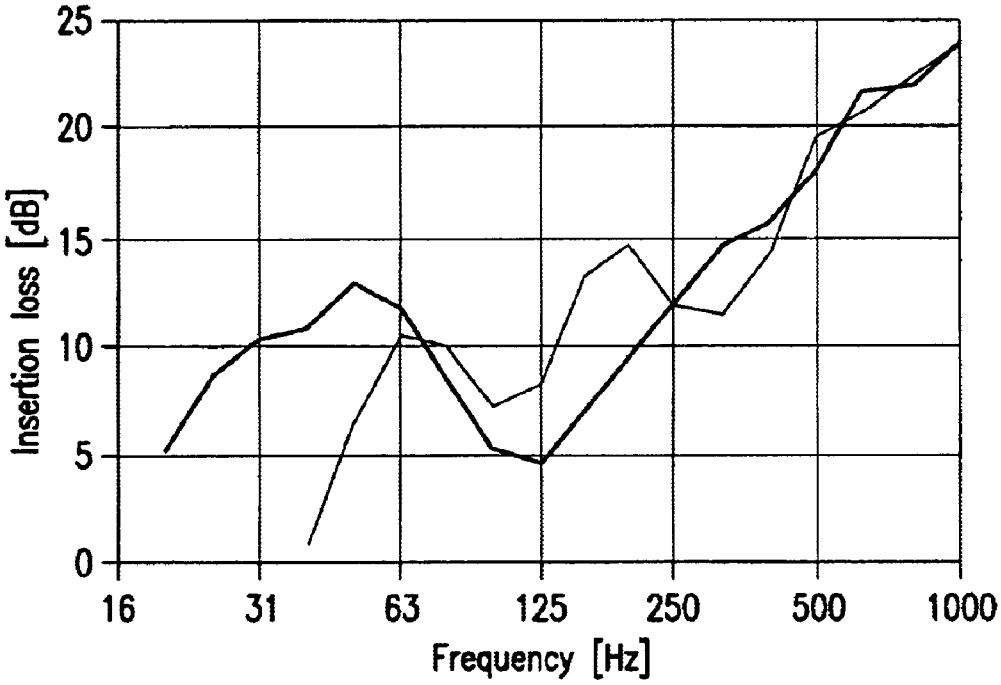
FIG. 5 is a graph of insertion loss measured on the controlled waveguide according to FIG. 4, with and without amplification.
Figure 6:
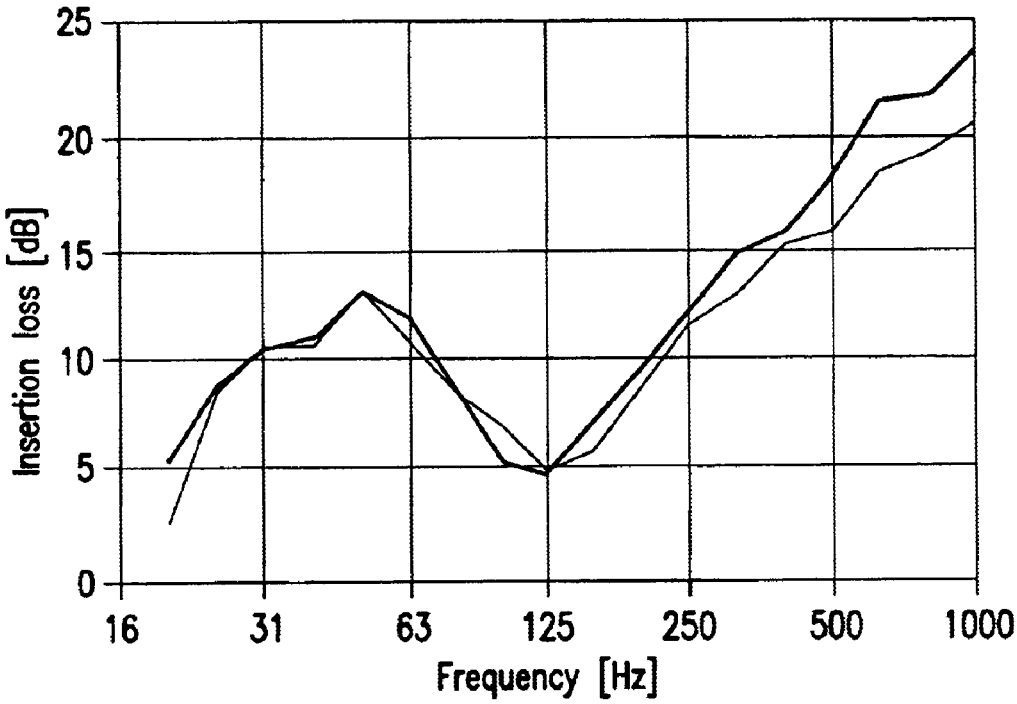
FIG. 6 is a graph of insertion loss measured on the controlled waveguide according to FIG. 4, with amplification at an air temperature of 20_C. and 150_C. in the duct.
Figure 7:
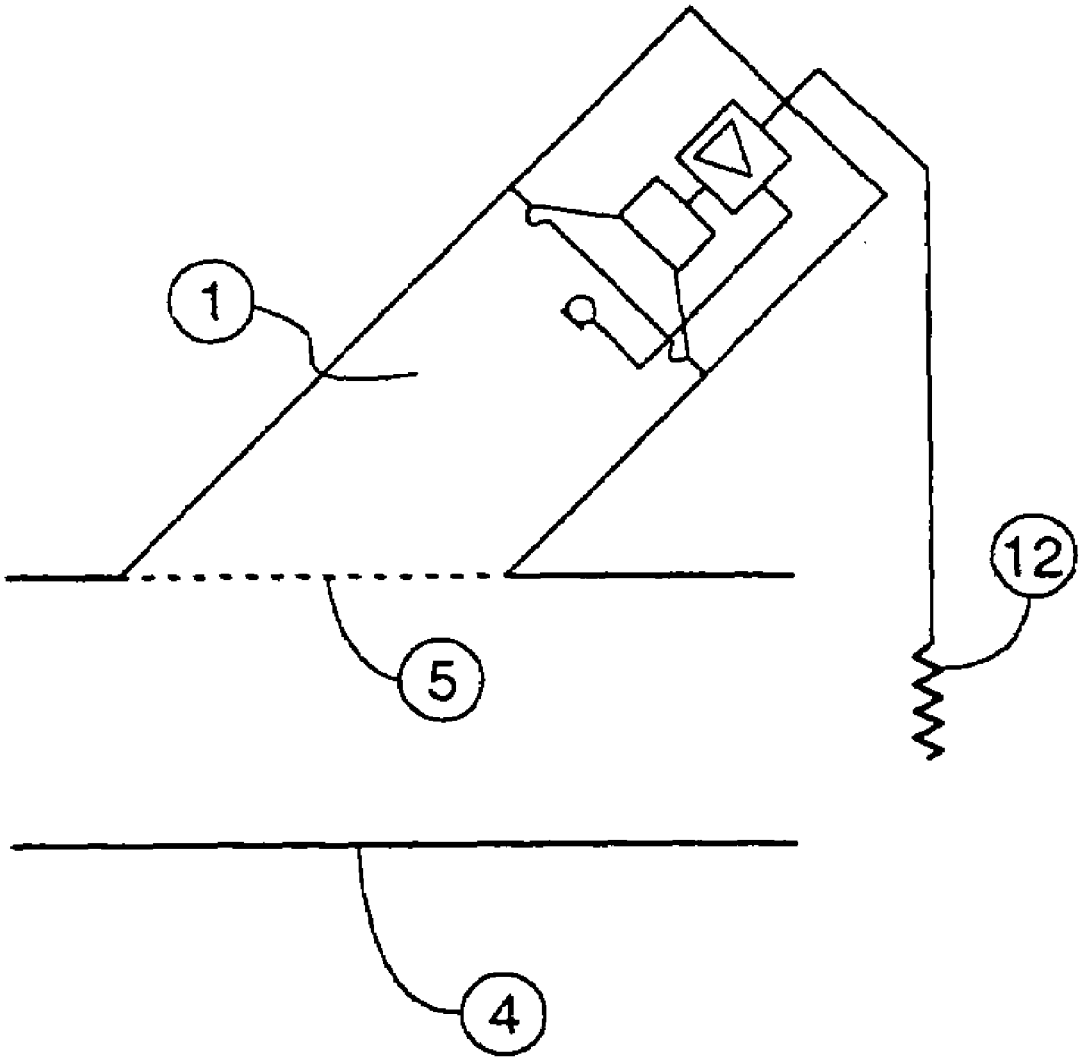
FIG. 7 is a schematic view of a controlled waveguide with a hollow chamber projecting obliquely from the duct.
Figure 8:
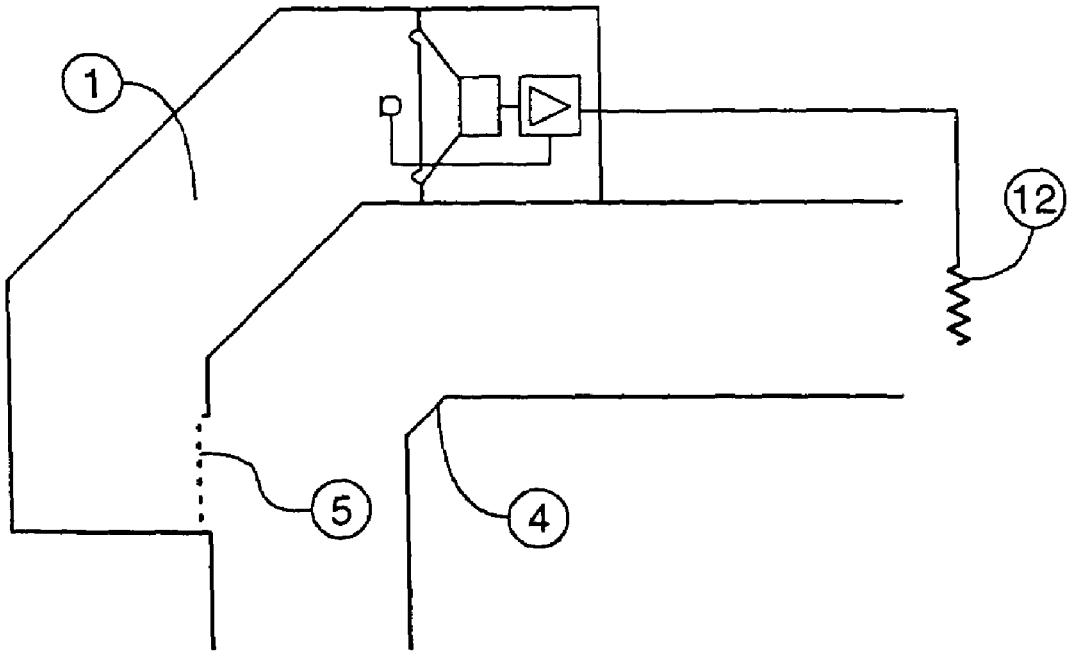
FIG. 8 is a schematic view of a controlled waveguide with a hollow chamber conforming to a bent duct.
Figure 9:
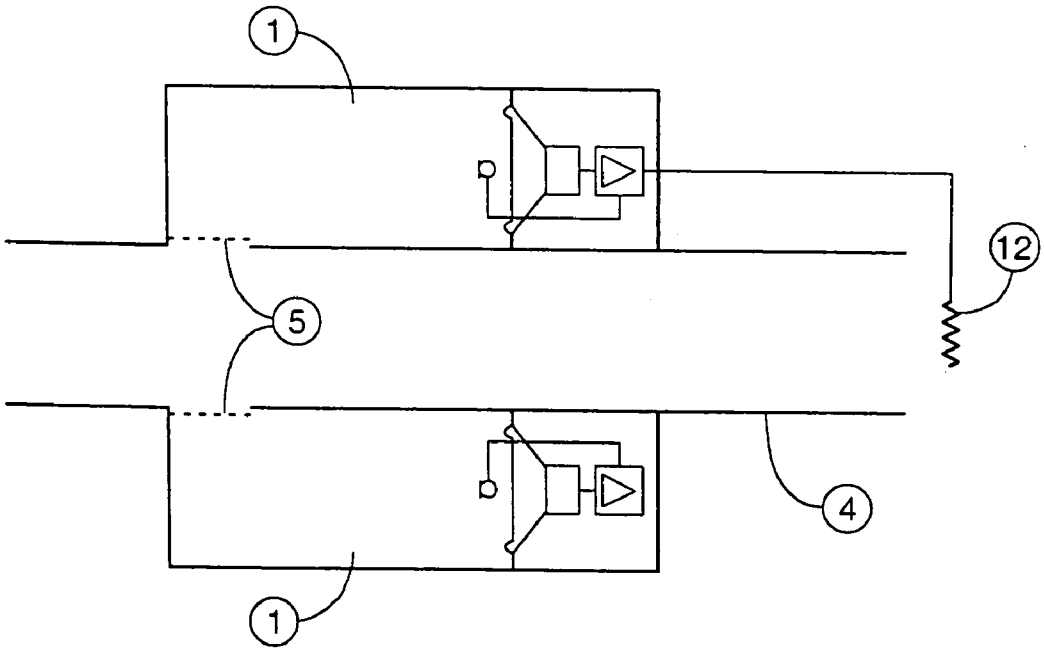
FIG. 9 is a schematic view of a controlled waveguide with an aerodynamically expedient configuration and positioning in the manner of a central slide inside a large duct.
Figure 10:
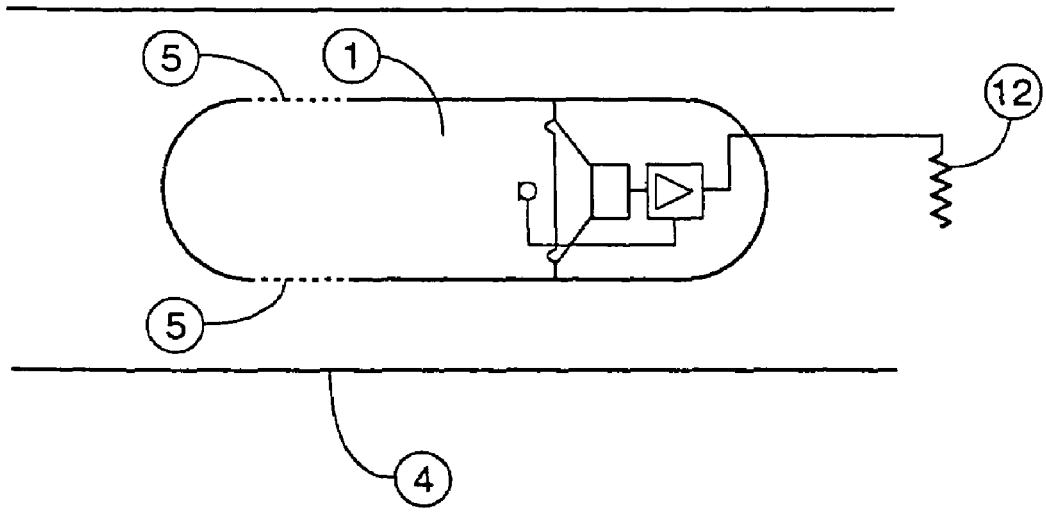
FIG. 10 is a schematic view of yet another embodiment of a controlled waveguide.

FIG. 4 illustrates an embodiment of the inventive controlled waveguide in which the attenuation levels achieved in combination with a conventional passive attenuator (18) on the opposite duct wall, which are indicated in FIG. 5, represent the two boundary cases in the frequency range as a function of the set gain (11). The contrastive indication of the attenuation measured at 20° C. and 150° C. in the duct, which is presented in FIG. 6, emphasizes the low influence of temperature on the attenuation of the inventive controlled waveguide according to FIG. 4.

FIGS. 7 through 10 show further embodiments of the controlled waveguide of the present invention. Similar reference numerals have been used to designate parts having functions similar to the described in conjunction with the embodiments of FIGS. 1 through 4.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Controlled acoustic waveguide for use with an elongate hollow chamber, connected to at least one sound-transmitting duct via an opening on its first end surface thereof, comprising a microphone for detecting membrane vibrations so as to allow tunability of longitudinal resonances of the hollow chamber to a sound spectrum to be attenuated, the microphone being located directly in front of a membrane of at least one loudspeaker on a second end surface of the hollow chamber, and an amplifier for inverting a microphone signal, with feedback of the inverted microphone signal to said loudspeaker being in an amplified form in dependence on a sensor signal characteristic of sound in the sound-transmitting duct.

2. Controlled waveguide according to claim 1, wherein the opening is provided with a sound-transmitting protective cover made of one of a perforated sheet, a non-woven material and sheet materials.

3. Controlled waveguide according to claim 1, wherein the hollow chamber projects one of orthogonally and obliquely from the duct or conforms to a straight or bent wall of the duct.

4. Controlled waveguide according to claim 3, wherein a thermal insulating layer is provided between a wall of the duct and a wall of the hollow chamber when the hollow chamber conforms to the wall of the duct.

5. Controlled waveguide according to claim 1, wherein at least one wall of the hollow chamber is provided with cooling elements at least over part of the surface of the at least one wall.

6. Controlled waveguide according to claim 1, wherein the hollow chamber has a forced cooling apparatus a thermal exchanger type or a Peltier element type therein.

7. Controlled waveguide according to claim 1, wherein transverse partitioning is arranged to subdivide the hollow chamber into tubes of different lengths.

8. Controlled waveguide according to claim 1, wherein walls of said hollow chamber are provided with a sound absorptive cladding over at least a portion of the surface or their entire surface thereof.

9. Controlled waveguide according to claim 1, wherein the sensor signal is comprised of temperature sensors, rotational speed sensors and measuring elements for the gas flow of burners and exhaust gas systems characteristic of the sound spectrum occurring in the duct.

10. Controlled waveguide according to claim 1, wherein a plurality of the at least one duct have side walls with a rectangular cross-section and a plurality of controlled waveguides are thereon.

11. Controlled waveguide according to the claim 1, wherein the hollow chamber configured as a circular and extends along a periphery of a duct.

12. Controlled waveguide according to the claim 1, wherein a central slide is positioned inside the duct configured rectangular or cylindrically so as to present an aerodynamically configuration or cylindrical duct.

13. Controlled waveguide according to claim 1, wherein an acoustically effective membrane or plate communicates with said duct in lieu of the sound-transmitting opening.

14. Method for absorbing sound using a controlled acoustic waveguide, comprising:

connecting an elongate hollow chamber to a sound-transmitting duct via an opening on a first end surface of the hollow chamber, locating a microphone directly in front of a loudspeaker on a speaker on a second end surface of the hollow chamber, detecting membrane vibrations of the loudspeaker via the microphone, inverting a microphone signal representative of the detected membrane vibrator, and amplifying and feeding both the inverted microphone signal to the loudspeaker in dependence on a signal characteristic of sound in the sound-transmitting duct.

* * * * *